United States Patent [19]

Newman

[11] 4,159,695

[45] Jul. 3, 1979

[54] PASTE APPLICATOR

[76] Inventor: August B. Newman, 2221 Linn La., Las Vegas, Nev. 89110

[21] Appl. No.: 864,672

[22] Filed: Dec. 27, 1977

[51] Int. Cl.[2] ..... B05C 3/02

[52] U.S. Cl. ..... 118/413; 118/415

[58] Field of Search ..... 118/413, 415, DIG. 17, 118/43

[56] References Cited

U.S. PATENT DOCUMENTS

| | | | |
|---|---|---|---|
| 1,033,282 | 7/1912 | Sleeper | 118/415 |
| 1,725,261 | 8/1929 | Ernst | 118/415 |
| 3,292,575 | 12/1966 | Letterly | 118/415 X |
| 3,389,680 | 6/1968 | Moore | 118/415 X |

*Primary Examiner*—John P. McIntosh

*Attorney, Agent, or Firm*—Seiler & Quirk

[57] ABSTRACT

A wallpaper paste applicator comprises a container having an inclined tray bottom portion along which a strip of wallpaper travels with its decorative surface facing downward. The paper is pulled through a slot in the forward portion of the apparatus formed by a vertically adjustable wall and the bottom of the tray. A quantity of paste is maintained on top of the wallpaper in the tray, and is distributed to the back of the paper by a flexible notched wiping bar.

4 Claims, 6 Drawing Figures

PASTE APPLICATOR

BACKGROUND OF THE INVENTION

Flexible wall coverings, such as wallpaper and fabric, are commonly applied to walls for decorative and protective purposes. These materials are generally attached to the wall by application of a paste to the back portion of the covering material, and by sticking floor-to-ceiling length strips of the paper to the wall. Application of paste to the paper is usually accomplished by cutting the paper into strips of the desired length, placing the strips face down on the floor, paste table, or other large surface, and wiping the paste on the back of the paper with a brush or similar spreading instrument. This procedure is somewhat messy and time consuming, and also frequently results in uneven application of paste to the back of the paper. This can result in the paper having bubbles or bulges where the material has not adhered to the wall, and may even result in the paper coming loose.

Several devices have been developed for the purpose of simplyfying and expediting the application of paste to paper strips. For example, Beach, U.S. Pat. No. 2,191,225, discloses a rotating drum applicator wherein a revolving cylinder picks up paste from a well and applies it to the back of a paper which rolls over the upper portion of the cylinder. Merrifield, U.S. Pat. No. 2,717,575, shows a paste containing trough with slots on either side of the bottom through which a paper strip travels. A spring-loaded foot serves to spread the adhesive on the paper strip. Hansen, U.S. Pat. No. 3,169,080, discloses a collapsible easel-type pasting frame which provides a surface which holds the paper and permits application of the paste with a conventional paint roller.

A pasting machine similar in some respects to applicants' is disclosed in Moore, U.S. Pat. No. 3,389,680. The Moore device is a ladder mountable trough which is filled with paste and which applies the paste to the backing of the wall covering in a manner similar to the Merrifield disclosure. The paper strip travels face down along the bottom of the trough and exits the trough through a slot at one end of the trough. The paste is spread uniformly across the back of the paper by a reticulated surface on the upper portion of the slot; the paper is pressed against the reticulated surface by a biased clamp located underneath the paper strip. The reticulated surface is a fabric mesh or net formed of loosely woven filaments. Difficulties have been encountered with the use of machines having the design of the Moore patent in that the reticulated applicator surface becomes plugged and must be frequently cleaned or changed, and the uniform layer of paste on the back of the paper does not permit proper adhesion of the paper to the wall unless the wall is perfectly smooth. If the wall has usual imperfections in the surface, the amount of paste applied uniformly does not travel along the back of the paper to fill up the imperfections and thereby promote good bonding between the wall and the paper.

Accordingly, it is an object of the invention to provide a paste applicator which is very simple to construct and to use, and yet which provides very rapid application of paste to wallpaper strips. It is a further object of the invention to provide a paste applicator which allows the operator to pull the paper through the apparatus at any speed he desires, and which includes means for holding the ends of each paper roll to allow a new roll to be attached when the end of a roll being pasted is reached.

It is still a further object of the invention to provide a paste applicator which applies the paste to the paper in continuous lengthwise ridges, rather than in a uniform thickness, thereby permitting proper adhesion of the paper to a wall having surface imperfections. It is yet a further object of the invention to provide a paste applicator having an applicator bar which is quickly and easily replaced.

These and other objects of the invention will become apparent to one skilled in the art through the description of the following specific embodiment of the invention.

SUMMARY OF THE INVENTION

Apparatus for applying paste to an elongate flexible sheet of material comprises a frame having sidewalls and a removable front wall, an inclined paste holding tray portion, fastening means for removably attaching the front wall to the frame, means for adjusting the vertical position of the front wall and the frame, and a paste applicator extending substantially along the entire length of the bottom of the front wall comprising a soft wiping bar having a plurality of notches therein to distribute the paste in continuous longitudinal lines along the sheet of material.

BRIEF DESCRIPTION OF THE DRAWINGS

The invention is best understood with reference to the drawings in which.

DETAILED DESCRIPTION OF THE INVENTION

Figure 1:
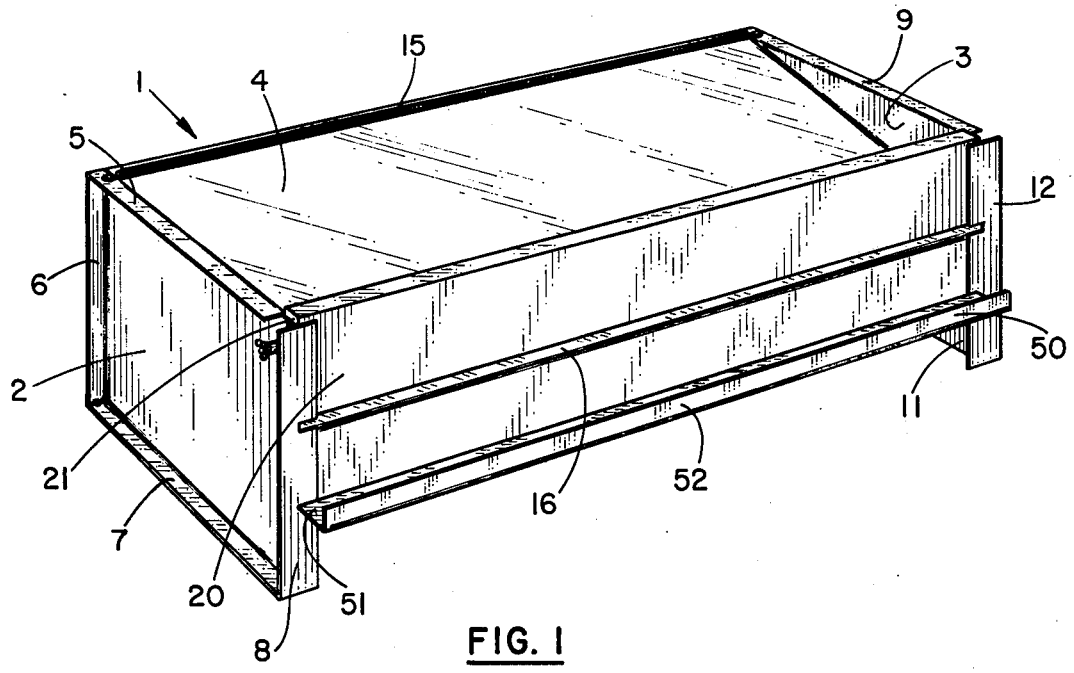
FIG. 1 is a perspective view of the applicator of the invention.

Referring to the drawings, pasting machine 1 comprises two sheet metal end panels 2 and 3 and inclined tray portion 4. Edge panel 2 is surrounded by flange members 5, 6, 7, and 8, and edge panel 3 has corresponding flanges 9, 10, 11, and 12. Flanges 7 and 11 form feet which support the unit. Helical tension spring 15 is mounted across the width of the tray at the rear of flanges 5 and 9 and serves to maintain the paper flat as it is threaded between the spring and the tray. The bed of the incline tray 4 serves as a track for the wallpaper, which passes under the spring downwardly along the tray face down, and extends out through the front of the apparatus through a slot 16 formed beneath the forward end 17 of the tray and the lower end 18 of the removable front wall 20 of the pasting apparatus.

Front wall 20 is a removable ¾" thick wooden dam which is mounted in two slots 21 and 22 in side panels 2 and 3 respectively. Threaded pin members 23 and 24 are attached to either end of the wooden dam and slideably engage the vertical slots, which are open at the top and extend downwardly approximately half the distance to the tray surface. Wing nuts 25 and 26 having hollow cylindrical shafts engage the threaded pins and hold the wooden dam at the desired vertical elevation. When the wing nuts are tightened, the ends of the cylindrical shafts on the wing nuts engage the outside surface of panels 2 and 3, thereby locking the panel in place.

Figure 4:
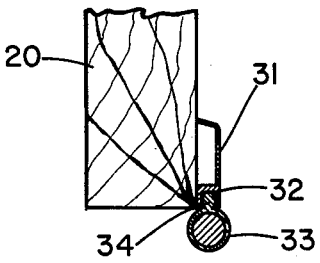
FIG. 4 is a partial side section view of the front wall of the machine showing the applicator bar.
Figure 6:
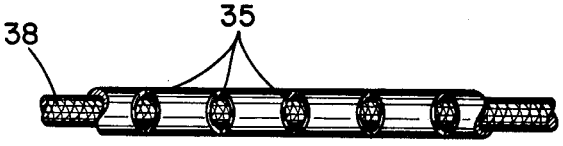
FIG. 6 is a partial bottom view of the wiper bar.
Figure 5:
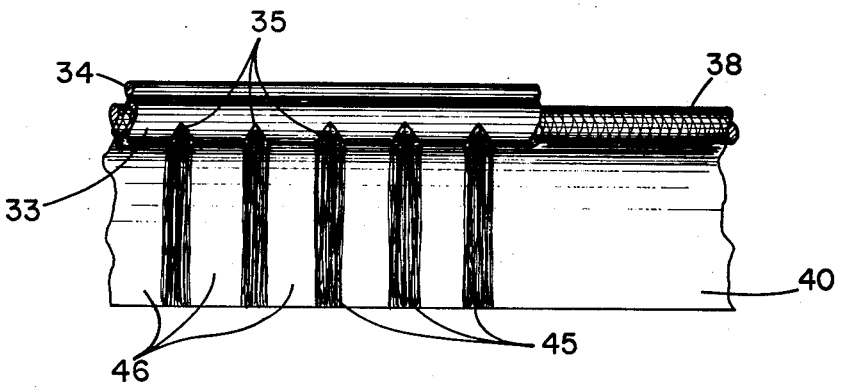
FIG. 5 is a partial section view of the wiper bar.

The most important feature of the pasting machine of the invention is the applicator member 30 which is attached to the lower inside portion of the wooden dam. The applicator, best seen in FIGS. 4 and 5, extends the entire length of the wooden dam. It consists of a metal mounting bracket 31 having a "h"-shaped groove 32 extending the entire length of the bracket and located at the lower portion thereof. The bracket is mounted on the inner portion of the wooden dam by screws (not shown). The mounting bracket carries a tubular vinyl plastic wiping member 33 having a solid ear portion 34 which is mounted in the groove 32 of the mounting bracket. Suitable applicators may be fabricated from commercially available weatherstripping, such as the type manufactured by Macklanburg Duncan Company of Oklahoma City, Oklahoma, under the trade name "Jam-Up." Tubular portion 33 is hollow soft vinyl plastic, and has a plurality of notches 35 uniformly spaced along the lower edge thereof. The notches consist of a series of inverted "v" shaped cuts in the bottom portion of the wiping member, extending symetrically from front to back. A front view of the wiping member is shown in FIG. 5; a bottom view of the member is shown in FIG. 6. A heavy woven cord 38 is threaded through the tubular applicator and is exposed in the notches. The cord is a woven fabric, preferably a synthetic fabric such as nylon, of a type similar to that used for clothesline. The cord is preferably of an outside diameter approximately the same as the inside diameter of the tubing, allowing a slideable fit therebetween. In a preferred mode of the invention the cord has a cross section about ¼" in diameter, and the applicator tubing has cross sectional dimensions of approximately ⅜" outside diameter and slightly greater than ¼" inside diameter.

The particular design of the wiping bar is extremely important to the proper application of paste to the paper. As the paper 40 is drawn through slot 16, the paste 41 in the incline tray is drawn through notches 35 in continuous ridges 45 along the paper. Little or no paste is applied on the spaces 46 between the ridges of paste. It has been found that when strips of paper are applied to the wall with vertical ridges of paste on the back, far better adhesion is obtained than if the paste were uniformly applied across the surface of the paper. After the paper is applied to the wall the outer surface of the paper is smoothed with a brush or other instrument, spreading the paste evenly between the wall and the paper. Apparently when the paste is smoothed after the paper is applied to the wall, the paste then fills in any imperfections in the wall, and a superior, long-lasting adhesion is obtained.

The concentric configuration of the soft wiping bar portion with the rigid, rough surface of the cord appears to provide the optimum paste applying means. The vinyl tubular surface is soft and will not damage the paper, and provides a resonably effective seal between the paste in the tray and slot 16. The cord threaded through the tube provides strength to the vinyl tube, while allowing paste to flow freely through the notches. The notches are located uniformly along the length of the tube, with a frequency of from about 2 to about 4 notches per inch, preferably about 3 notches per inch of tube length.

Drip tray 50 is located at the forward portion of the paste machine underneath slot 16 to catch any excess paste which may drip through the slot. The tray consists of a horizontal shelf portion 51 with an upwardly extending vertical flange 52. Vertical flange 52 also serves as a cutting bar for shearing off the paper when the desired length has been pulled through the pasting machine.

Figure 2:
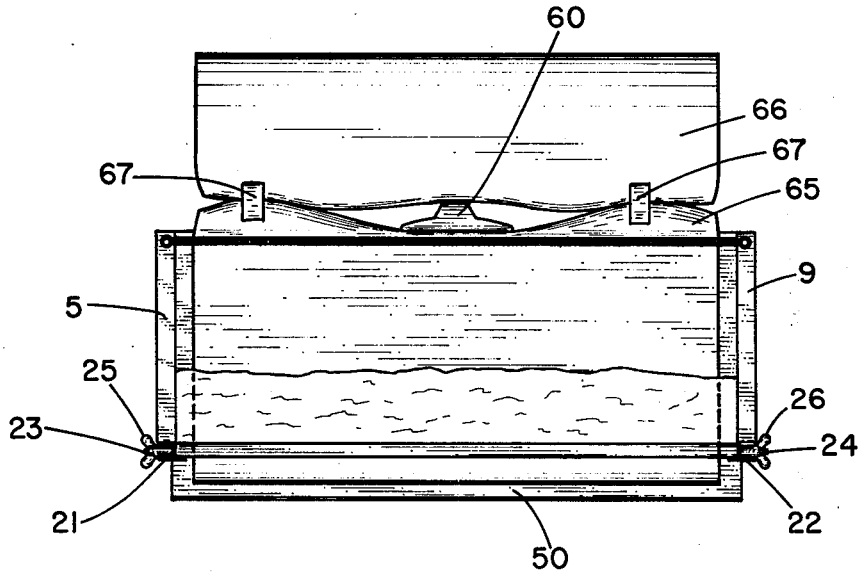
FIG. 2 is a top view of the applicator showing attachment of a new roll of paper to the old roll.

Another important feature of the paste machine of the invention is a spring-mounted clamp 60 mounted on a rear panel 61 of the frame. This clip, which is biased in a closed position, is used to hold the end of one roll of paper while that roll is attached to the new roll. This is done by clamping the end of the old roll 65 to back panel 61 as shown in FIG. 2, tightening the paper by pulling it through the applicator, attaching the front end of new roll 66 with short pieces of pressure sensitive adhesive tape 67, placing a long piece of tape along the seam, and releasing the clamp. The new roll of paper is then threaded through the tray and under the paste as an extension of the old roll.

The dimensions of the paste machine of the invention may vary with the width of the wall paper to be applied. For wallpaper having a standard width of 28", the paster is preferably about 30" in length, i.e., between side walls 2 and 3, and is about 12" in width, i.e., between the slot 16 and the back panel 61. At its deepest portion, the inclined paste tray is about 4" deep. For wider wallpaper, for example the standard 54" width, the paster is approximately 60" long, and the other dimensions remain approximately the same. The machine is fabricated from 14 guage galvanized steel, except for the wooden dam which is a board having dimensions of approximately 30"×4"×¾".

The operation of the pasting machine is quite simple. Wallpaper from a roll 67 which may be held in any convenient manner is unrolled and threaded under spring 15 and down along the tray through slot 16. Front wall 20 is then fixed in place by sliding pins 23 and 24 into slots 21 and 22, allowing the distributing device 30 to rest on the paper. No additional pressure need be applied to the applicator other than the weight of the dam 20. The dam is then secured in place with wing nuts 23 and 24.

Figure 3:
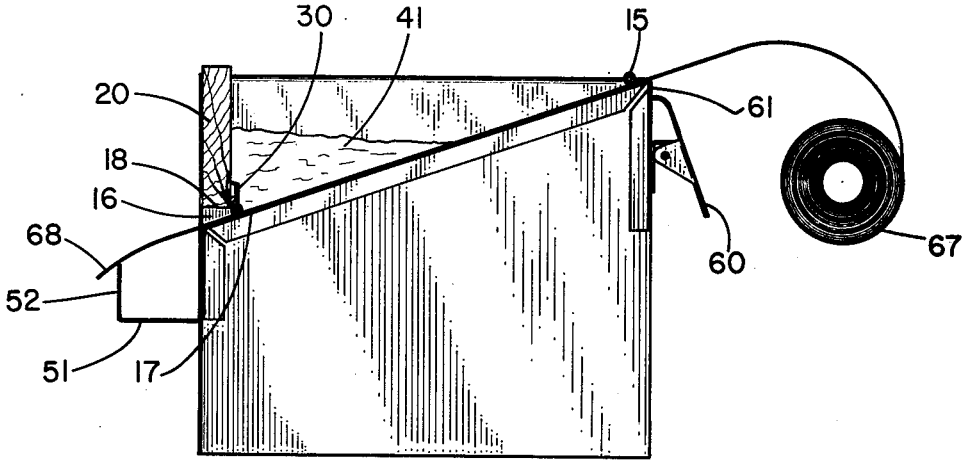
FIG. 3 is a side section view of the apparatus showing the paper traversing the machine.

Wallpaper paste of appropriate thickness is then poured into the trough formed by the dam and the inclined tray as shown in FIG. 3. This paste is replenished as the initial charge is used. The operator then grasps the end 68 of the wallpaper and draws the paper underneath the applicator tube 33. As the wallpaper passes underneath the applicator, ridges of paste as distributed onto the back of the paper as shown in FIG. 5. When the desired length of paper is pasted, the operator uses the vertical flange 52 of the drip tray to shear the paper. This procedure is repeated until the end of the roll is reached. When a new roll is to be threaded through the machine, it may be attached to the old roll in the manner described above. The old roll is clamped to the rear of the machine using biased clip 60, and the new roll is layered over and attached to the old roll as shown in FIG. 2. The roll may then continuously be drawn through the machine threading the new roll through the slot. The lengths of wallpaper may be cut using a separate blade and using the vertical flange 50 of the drip tray as a guide, or the upper edge of the flange may be sharpened and used directly as a cutting edge.

Many modifications may be made to the invention as described and will be apparent to those skilled in the art. The most significant feature of the invention is the applicator blade, which consists of a flexible wiping member having notches therein for distributing the paste in ridges along the back of the paper being drawn beneath the applicator. While a specific mode of the invention has been described in detail, the invention should be considered as illustrated but not limited by the description, which is defined only in the following claims.

I claim:

1. Apparatus for applying paste to an elongate flexible sheet of material comprising a frame having side walls, a rear wall, and a removable front wall, an inclined paste-holding tray portion located within said walls, the tray having a floor surface sloped downwardly toward the front wall, fastening means for vertically adjusting the position of the front wall in the frame, and paste applicator means extending substantially along the entire length of the front wall comprising a resilient wiping bar member comprising a flexible tube having a plurality of notches therein to distribute the paste in continuous longitudinal ridges along the sheet of material, and coaxial distributor means encased within the tube.

2. The apparatus of claim 1 wherein the distributor means comprises a cord having an irregular surface.

3. The apparatus of claim 1 also comprising clamp means for securing the elongate flexible sheet to the apparatus.

4. The apparatus of claim 3 wherein the clamp means is biased to maintain the clamp in a closed position.

* * * * *